US006029745A

United States Patent [19]

Broussard et al.

[11] Patent Number: 6,029,745

[45] Date of Patent: Feb. 29, 2000

[54] CASING CUTTING AND RETRIEVING SYSTEM

[75] Inventors: Andre N. Broussard, Nassau Bay; Geoff O. Rouse, Peterculter; Richard Segura, Houston; Mark W. Schnitker, Friendswood; Shane P. Hart, Houston, all of Tex.

[73] Assignee: Weatherford/Lamb, Inc., Houston, Tex.

[21] Appl. No.: 09/010,782

[22] Filed: Jan. 22, 1998

[51] Int. Cl.[7] ..... E21B 29/00

[52] U.S. Cl. ..... 166/298; 166/55.7; 294/86.34

[58] Field of Search ..... 166/298, 55.7, 166/98, 361; 294/86.26, 86.27, 86.28, 86.3, 86.31, 86.34

[56] References Cited

U.S. PATENT DOCUMENTS

| | | | |
|---|---|---|---|
| 1,867,289 | 7/1932 | Ventresca | 166/55.7 |
| 2,687,323 | 8/1954 | Stohn . | |
| 3,338,305 | 8/1967 | Pittman et al. | 166/361 X |
| 3,376,927 | 4/1968 | Brown | 166/361 |
| 3,732,924 | 5/1973 | Chelette et al. | 166/55 |
| 3,782,459 | 1/1974 | Murray . | |
| 3,848,667 | 11/1974 | Clark, Jr. | 166/55.6 |
| 3,983,936 | 10/1976 | Kennard et al. . | |
| 4,181,196 | 1/1980 | Darby et al. | 166/361 |
| 4,191,255 | 3/1980 | Rives | 166/297 |
| 4,550,781 | 11/1985 | Kagler, Jr. | 166/55.7 |
| 4,703,802 | 11/1987 | Bryan et al. | 166/298 |
| 4,883,118 | 11/1989 | Preston | 166/98 |
| 5,101,895 | 4/1992 | Gilbert | 166/55.8 |
| 5,146,989 | 9/1992 | Rouse | 166/339 |
| 5,253,710 | 10/1993 | Carter et al. . | |
| 5,318,115 | 6/1994 | Rouse | 166/298 |
| 5,823,255 | 10/1998 | Swiatowy et al. | 166/55.1 |
| 5,848,643 | 12/1998 | Carbaugh et al. | 166/85.4 |

FOREIGN PATENT DOCUMENTS

| | | | |
|---|---|---|---|
| 1184480 | 12/1967 | United Kingdom . | |
| 2 159 855 | 4/1985 | United Kingdom | E21B 31/16 |
| 2 259 930 | 9/1992 | United Kingdom | E21B 31/16 |
| 2159855A | 6/1994 | United Kingdom . | |
| 2 310 873 | 7/1997 | United Kingdom | E21B 29/12 |

OTHER PUBLICATIONS

"M.O.S.T. Subsea Wellhead Retrieval Tool," Weatherford Enterra, 1997.

"General Catalog 1974–1975" A–Z Int'l, pp. cover, 163–167, 174, 175, 178, 179, 181, 198, 1974.

LOR Composite Catalog, pp. 30, 31, 1984.

*Primary Examiner*—William Neuder

*Attorney, Agent, or Firm*—Guy McClung

[57] ABSTRACT

A system has been invented for cutting wellbore casing and retrieving casing and a wellbore device connected thereto, the system, in one aspect, including engaging apparatus for releasably holding the wellbore device, casing cutting apparatus interconnected with and below the engaging apparatus for cutting casing in a wellbore, the wellbore device connected to the casing, and locking apparatus for selectively and releasably locking the engaging apparatus holding the wellbore device. In one aspect the engaging apparatus has one or more movable latching arms for releasably holding a wellbore device, e.g. but not limited to a wellhead and the arms are mounted below a top bonnet that holes therethrough so that the flushing of debris and/or cutting from the tops of the arms is facilitated. In one aspect, a drain sub is used to reduce flow to the casing cutter so that the circulation of debris and/or cuttings is inhibited.

22 Claims, 4 Drawing Sheets

FIG. 3F
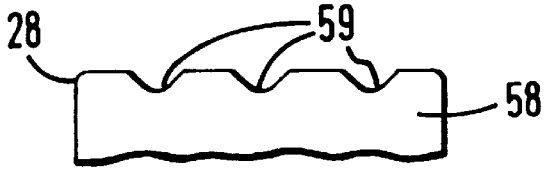
FIG. 3G
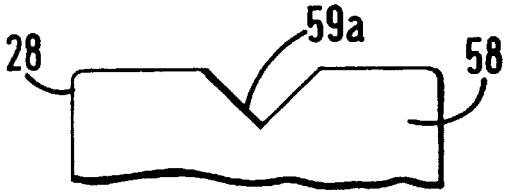
FIG. 4A
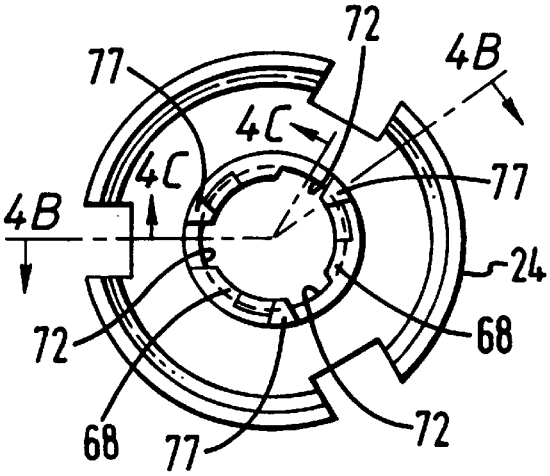
FIG. 4B
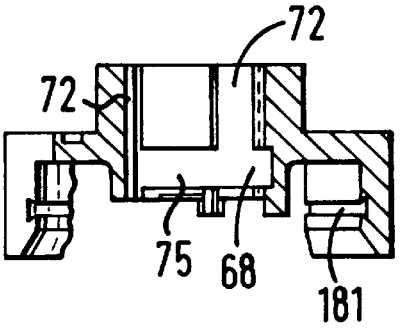
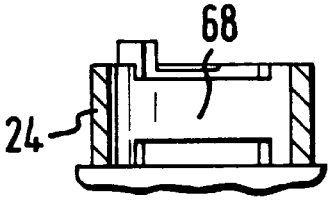
FIG. 4C
FIG. 4D
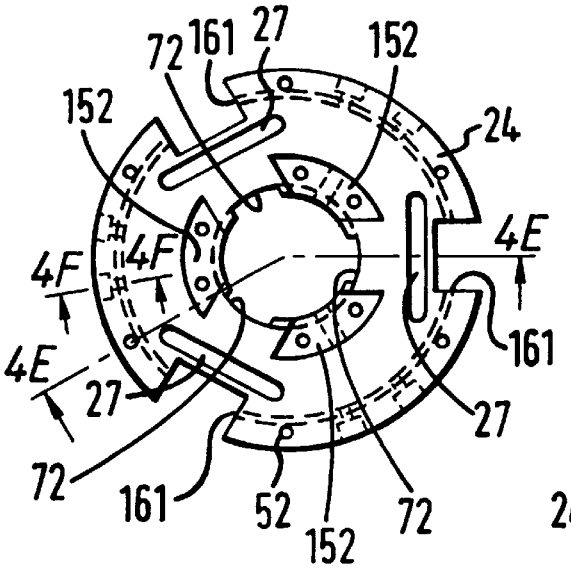
FIG. 4E
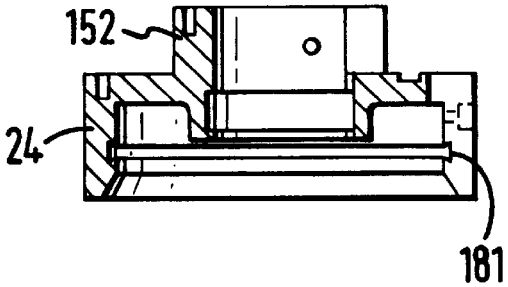
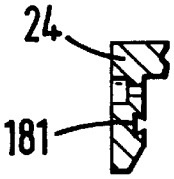
FIG. 4F FIG.5A
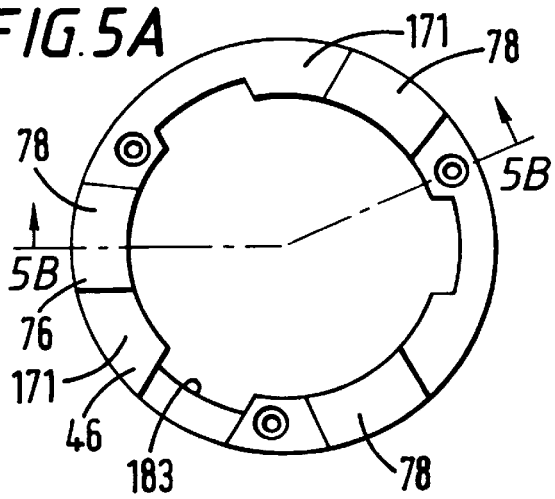
FIG.5B
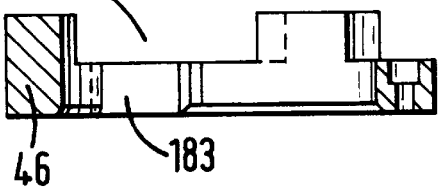
FIG.6
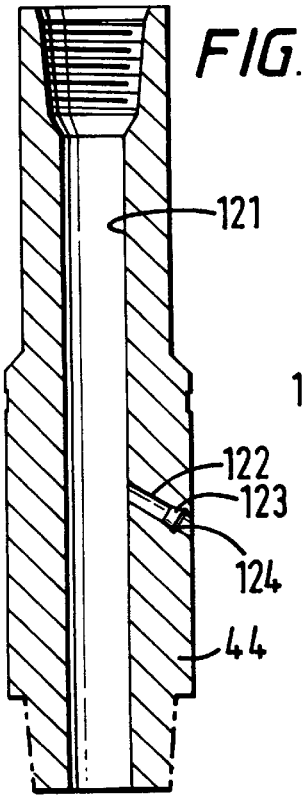
FIG.7A
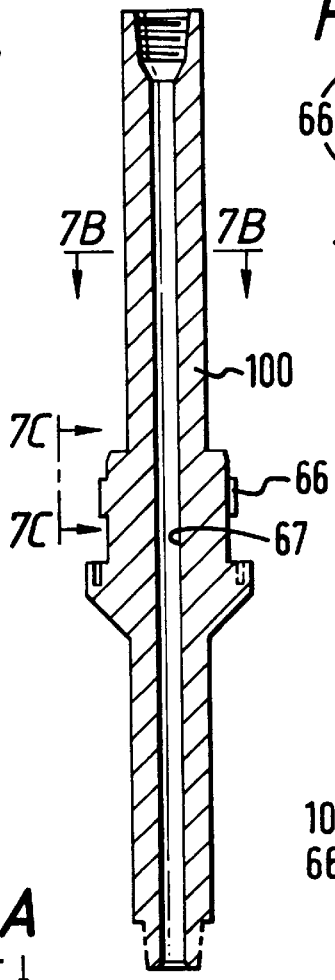
FIG.7B
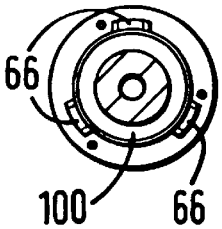
FIG.7C
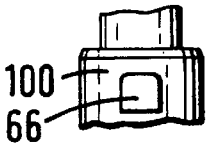
FIG.8A
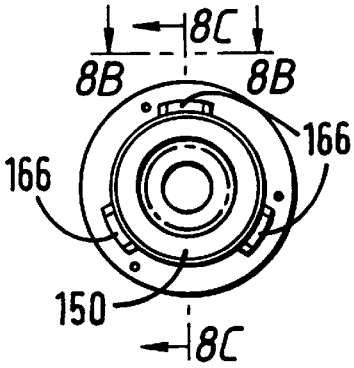
FIG.8C
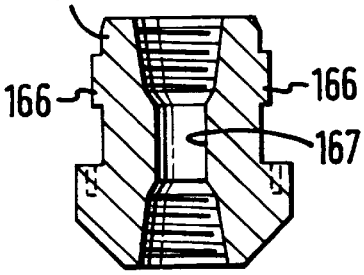
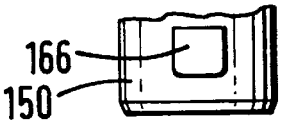
FIG.8B

CASING CUTTING AND RETRIEVING SYSTEM

BACKGROUND OF THE INVENTION

1. Field of the Invention

This invention is directed to wellbore casing cutting and retrieval tools and, in one aspect, to such tools used in retrieving wellheads in a marine environment.

2. Description of Related Art

It is known to cut and retrieve wellheads mounted on base plates and from which a casing string extends down into a wellbore, using a single-trip tool which combines a casing cutter and a grapple for releasably engaging the wellhead. Such systems are disclosed in U.S. Pat. No. 5,318,115, co-owned with the present invention and incorporated fully herein and in International Patent Application No. WO 91/02138.

There has long been a need for such systems in which movable locking arms are freely movable and not impeded by debris or cuttings. There has long been a need for such systems which are not inadvertently released from a wellhead.

SUMMARY OF THE PRESENT INVENTION

The present invention discloses, in certain embodiments, a casing cutting and retrieving system that, preferably in a single-trip into the wellbore, cuts casing in the wellbore at a desired location; latches onto a wellhead located e.g. at the mudline; and then is retrievable from the wellbore with the wellhead and the casing remaining above the level of the cut. In one aspect such a system includes a latching system or grapple device for releasably holding a wellhead (and a portion of casing above a cut) and a casing cutter connected below the latching system. In one aspect casing is cut about 15 feet below the mudline. In certain aspects one or more mud motors are used in conjunction with (in the same string as) the latching system and the casing cutter to rotate the casing cutter for cutting. Appropriate stabilizers may be used in the string, e.g. above and/or below the mud motor(s), and a bull sub may be connected below the casing cutter. In one embodiment with a mud motor, one or more safety clamps are used on the mud motor's upper part above the gripping apparatus to limit the dowmward movement of the upper part of the mud motor thereby limiting the amount of casing that is cut (and to be retrieved) and to insure that cutting ceases at a desired point. In another aspect in which a drill string is used that is rotatable (e.g. in a common rotary rig) without a mud motor, no safety clamps are used; and, in one aspect of such a system, a marine swivel is used on top of the grapple apparatus to facilitate rotation.

In one aspect the latching system includes a central mandrel with a fluid flow bore therethrough from top to bottom, with threaded ends at top and bottom. The central mandrel extends through a grapple housing. The grapple housing has a bonnet or top base plate thereon and a plurality (e.g. two, three or four) movable grapple arms pivotably mounted on pivot pins secured in recesses in the grapple housing. Upward movement of the central mandrel brings a shoulder of the central mandrel into contact with an inwardly projecting portion of the grapple arms, causing them to pivot so that a depending latch portion moves into engaging contact with a wellhead.

In one aspect, to facilitate the movement of debris and/or cuttings away from a top surface of the grapple arms, one or more holes is provided through the top base plate of the grapple housing, permitting fluid to wash over the arms' top surfaces. In one aspect there is at least one hole through the base plate corresponding to each arm. In another aspect, a series of indentations or valleys is provided in the top surfaces of the arms for holding debris and/or cuttings so they do not impede arm action and, in one aspect, for facilitating the flow of debris/cuttings away from the arms' top surfaces. In another aspect one or more holes are provided through the arms to facilitate debris removal.

In certain embodiments the central mandrel has one or more lugs projecting laterally therefrom which are movable into and out from corresponding recesses in the grapple housing. In one embodiment there are three such lugs and recesses. The lugs and recesses are positioned so that when the mandrel is raised to activate the arms to latch onto a wellhead, the lugs are movable into the recesses by slightly rotating the central mandrel, thereby releasably locking the central mandrel in place with respect to the grapple housing and locking the central mandrel in place so that the grapple arms are releasably locked in position latching onto the wellhead.

In one aspect a system according to the present invention has a fluid pressure reliever or bypass at some point in a string that includes a casing cutter to reduce fluid flow to the casing cutter thereby inhibiting or preventing the tendency of debris and/or cuttings to flow upwardly in the wellbore. Such debris/cuttings could clog the grapple apparatus and, if deposited on top surfaces of the latching arms, impede or prevent proper latching onto a wellhead.

A spacer sub or subs may be used anywhere in a string with the systems according to the present invention to correctly locate the casing cutter at a desired point in a cased wellbore It is, therefore, an object of at least certain preferred embodiments of the present invention to provide:

New, useful, unique, efficient, nonobvious devices for wellbore casing cutting and retrieving systems, and methods of their use;

Such systems with which the possibility of inadvertent release from a wellhead is reduced or eliminated;

Such systems with a positive locking mechanism for preventing inadvertent wellhead release;

Such systems with structure for facilitating the removal of debris from the top of movable grapple arms so that proper functioning of the arms is enhanced; and Such a system in which upward movement of debris and/or cuttings is inhibited or prevented.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 3F and 3G are end views of an arm of the system.

FIG. 4A is a bottom view and FIG. 4D is a top view of a grapple housing of a system according to the present invention.

FIGS. 4B–4C and 4E–4F show various cross-section views of the grapple housing of FIG. 4A.

FIG. 5A is a top view of a spline spacer according to the present invention.

FIG. 5B is a cross-section view along line 5B—5B of FIG. 5A.

FIG. 6 is a side cross-section view of a drain sub of the system of FIG. 2.

FIG. 7A is a side cross-section view of a central mandrel of a system according to the present invention.

FIG. 7B is a cross-section view along line 7B—7B of FIG. 7A.

FIG. 7C is a cross-section view along line 7C—7C of FIG. 7A.

FIG. 8A is a top view of a central mandrel for a system according to the present invention.

FIG. 8B is a cross-section view along line 8B—8B of FIG. 8A.

FIG. 8C is a side cross-section view of the mandrel of FIG. 8A.

DESCRIPTION OF EMBODIMENTS PREFERRED AT THE TIME OF FILING FOR THIS PATENT

Figure 1:
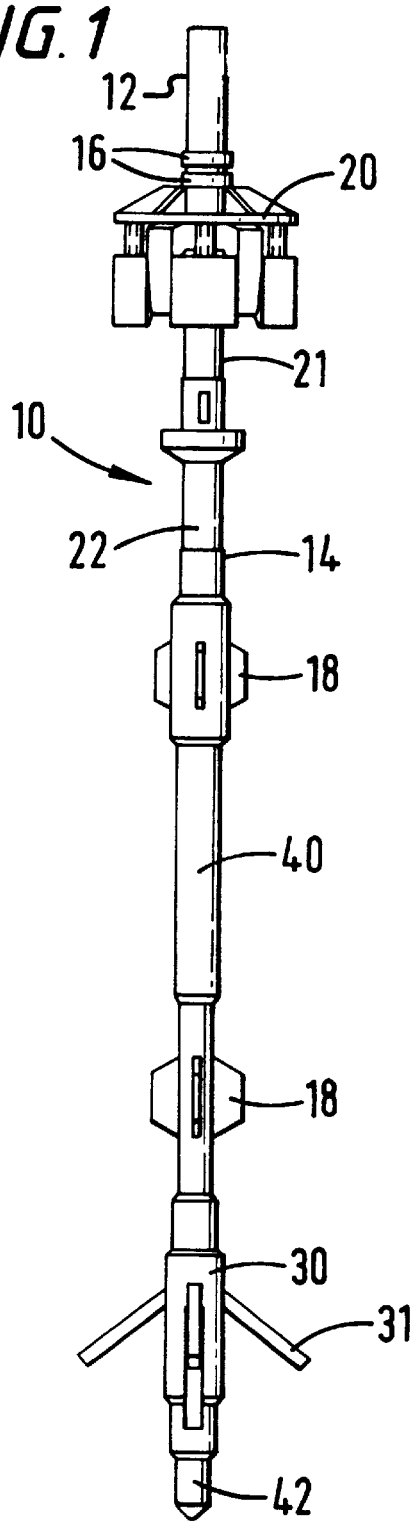
FIG. 1 is a side view of a system according to the present invention.

FIG. 1 illustrates a system 10 according to the present invention which has a grapple apparatus 20 and a casing cutter 30. An upper mud motor part 12 (e.g. as is typical with a power section, rotor, stator, and a power shaft that extends down to a lower mud motor part described below) is positioned in a drill string 14 in which the items are threadedly connected. Two safety clamps 16 are secured around the upper part of the mud motor 12. A lower part 22 of a central mandrel 21 of the grapple apparatus 20 is connected to a stabilizer 18. A lower mud motor 40 (e.g. as is typical with a bearing assembly and into which the power shaft extends) is connected in the string 14 below the stabilizer 18 and another stabilizer 18 is connected below the lower mud motor part 40. The casing cutter 30 is connected below the lower stabilizer 18. A bull sub 42, made e.g. of rubber-coated steel is connected below the casing cutter 30 and inhibits or prevents damage to the wellhead as the system is moved through it prior to cutting of the casing.

For the system of FIG. 1 (and of FIG. 2) any suitable known casing cutter, mud motor or motors may be used, as can any suitable known safety clamps, stabilizers, and bull subs.

Figure 2:
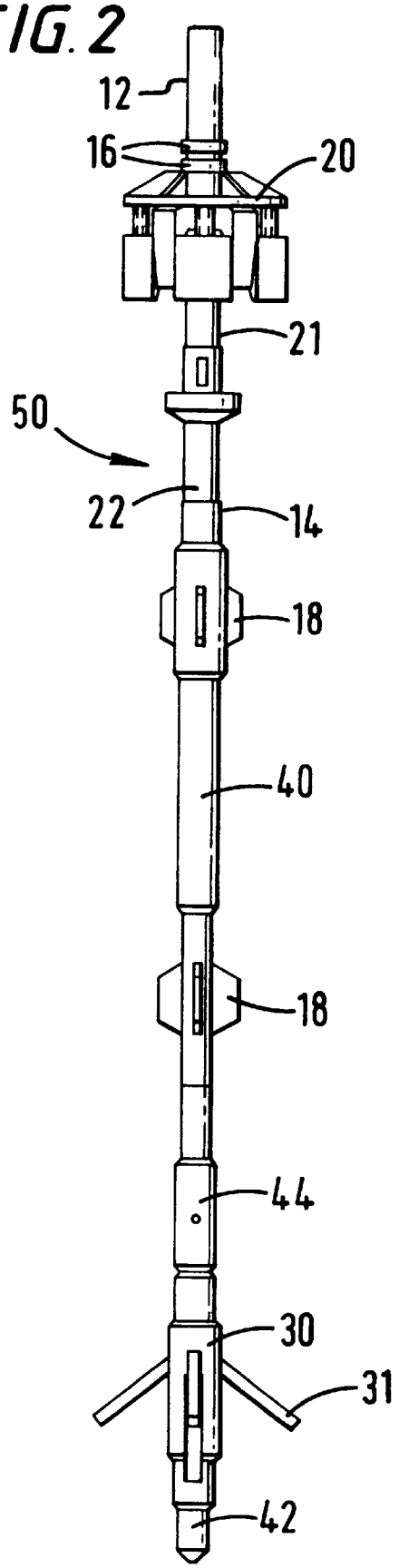
FIG. 2 is a side view of a system according to the present invention.

A system 50 of FIG. 2 according to the present invention is like the system 10 of FIG. 1, with the addition of a drain sub 44 between the lower stabilizer 18 and the casing cutter 30. The drain sub exhausts into a wellbore annulus outside the drain sub a portion of the fluid under pressure flowing from the lower mud motor 40. Although sufficient fluid pressure is still applied to the casing cutter to produce effective cutting, the reduction in fluid pressure results in a reduced tendency of cuttings and debris to be pumped up the wellbore annulus. In one particular embodiment the amount of cuttings circulated upwardly in the wellbore is significantly reduced and, in one preferred embodiment, substantially eliminated.

Figure 3A:
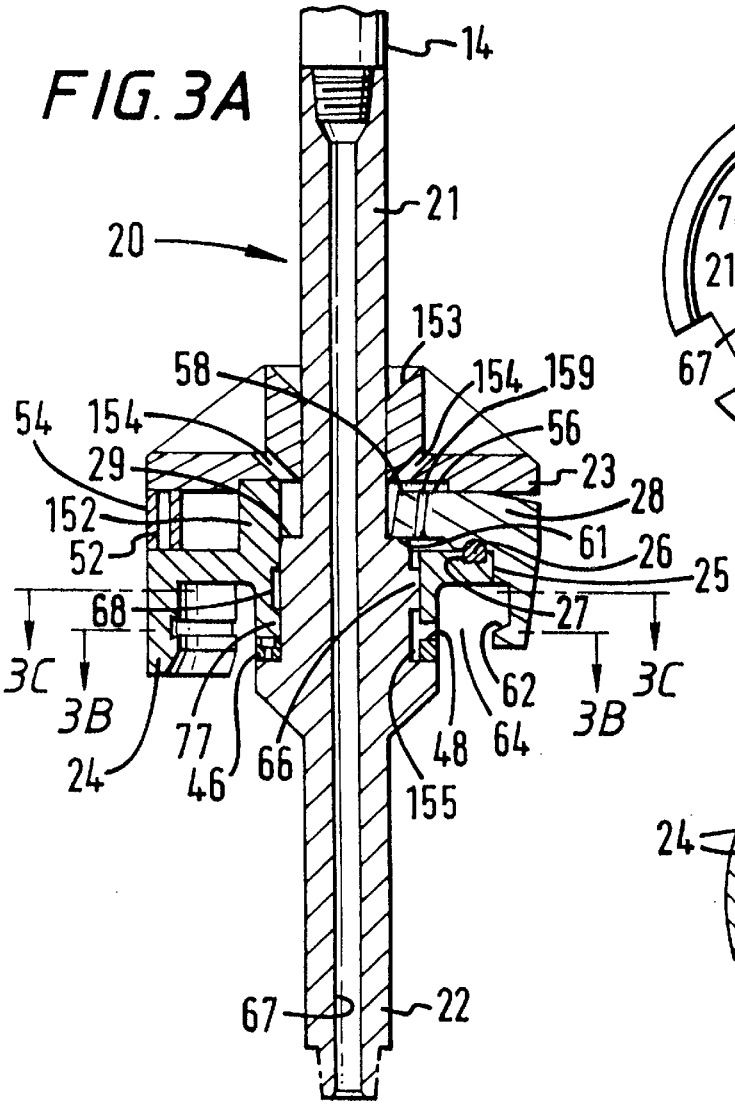
FIG. 3A is a side cross-section view of part of a system according to the present invention.
Figure 3B:
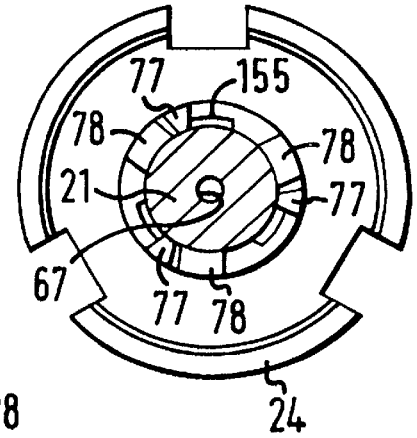
FIG. 3B and 3D show cross-section views along line 3B—3B of FIG. 3A.
Figure 3C:
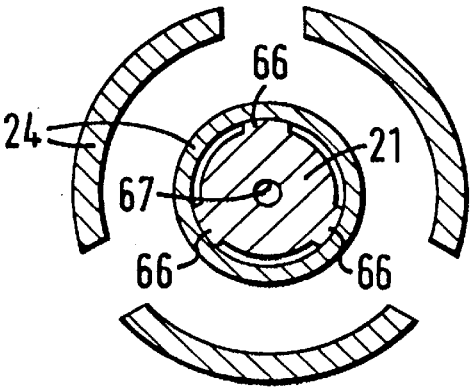
FIG. 3C and 3E show cross-section views along line 3C—3C of FIG. 3A.
Figure 3D:
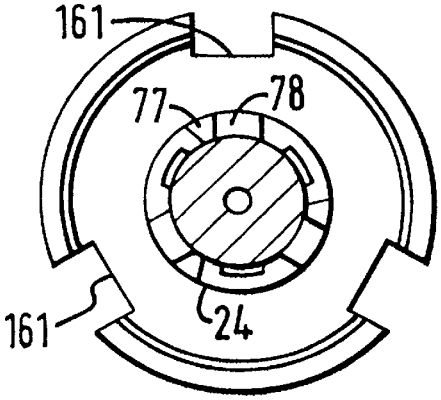
Figure 3E:
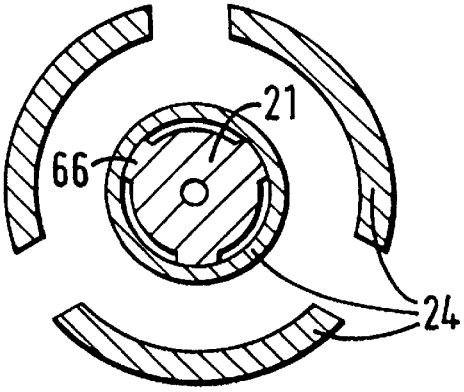

FIG. 3A shows a part of the grapple apparatus 20. The central mandrel 21 has a flow bore 67 therethrough and extends movably longitudinally and rotatably through a bonnet 23 and through a grapple housing 24. The grapple housing 24 has a plurality of arm supports 25 mounted thereon, each with a pivot pin 26 made of, e.g. hardened steel, secured in a slot 27 in each arm support. The pins 26 may be circular or, in one aspect they may be elongated (as viewed from above) and shaped to correspond to the shape of the slots 27. Arms 28 (three in this embodiment) are pivotably and latchingly mounted on the pivot pins so that upon upward movement of the central mandrel 21 an upper shoulder 29 thereof contacts a lower surface 61 of the arms causing them to pivot downwardly in arm slots 161 of the grapple housing to a position as shown in FIG. 3A with a lip latch portion 62 engaging an item to be held, e.g. a wellhead (not shown).

A spline spacer 46 is secured on the central mandrel 21 (e.g., by blots and/or welding). A top 48 of the spline spacer 46 serves to assure correct positioning of the central mandrel 21 with respect to the grapple housing 24 both for correct activation of the arm 28 and to correctly position cooperative locking apparatus to be described below. A spring (not shown) may be disposed between each arm 28 and the bonnet 23 to urge the arms 28 to an un-latched position.

The bonnet 23 is secured to the grapple housing 23 with a series of bolts extending through a series of holes 54 and through a series of support pillars 52 emplaced between the bonnet 23 and the grapple housing 24. The bonnet 23 also sits on pillars 152 extending upwardly from the grapple housing 24. Holes 15, permit fluid under pressure to flow to a top surface 56 of the arms 28 to flush debris and cuttings away so that proper movement of the arms 28 is not impeded when the central mandrel 21 moves up to activate the arms.

FIGS. 3F and 3G show an end view of an end 58 of one of the arms 28, illustrating a series of notches or valleys 59 (FIG. 3F) or one notch 59*a* (FIG. 3G) made or formed integrally in the arm. These notches or valleys 59 can contain debris, etc. in such a way that it does not impede proper arm movement. They also facilitate flushing of debris, etc. from the top of the arm by providing a channel for movement therefrom. Holes 159 through the arms 28 facilitate debris removal from the arms.

The system according to the present invention can be used, among other things, to retrieve any known wellhead and the parts that engage and/or accommodate the wellhead can be customized, configured, and positioned for any particular wellhead. This includes a space 64 between the arms 28 and the central mandrel 21.

FIGS. 3B–3E show various stages of operation of the system (e.g. a system as in FIG. 1 or 2). The central mandrel 21 has a plurality of projecting lugs 66 which are positioned for movement into and out of a groove 68 which extends around an interior of the grapple housing 24 and into which, through slots 72 in the grapple housing 24, the lugs 66 are movable to achieve cooperative releasable locking of the mandrel 21 in place. The slots 72 permit the lugs 66 to move into alignment with the groove 68 as the central mandrel 21 is raised (and the latching arms 28 grip a wellhead) so the lugs 66 can then be rotated into the groove 68. Initially as the central mandrel 21 is moved upwardly, the lugs 66 move up within the grapple housing 24 in slots 72 until they are at the level of the groove 68. Then the central mandrel 21 is rotated (to the left about 60 degrees—counterclockwise viewed from above) to move the lugs 66 into the groove 68, thus releasably locking the central mandrel in place so that the arms 28, now engaging an apparatus, e.g. a wellhead, do not inadvertently release from the item. Upon further subsequent right-hand rotation of the central mandrel 21, the lugs 66 again align with the slots 72 at which point the lugs 66 can move out of the grooves 68, downwardly in the slots 72, and away from the grapple housing 24, permitting release of the arms and disengagement of the arms from the item being held. In FIG. 4B, a lug 66 is locked in place in the groove 68 if it is in the area 75.

Lugs 77 projecting downwardly from the grapple housing 24 are movable in the areas 171 of the spline spacer 46. When the lugs 66 enter the groove 68, it is the lugs 77 abutting the raised areas 78 of the spline spacer 46 that stops movement of the lugs 66 in the groove 68 and prevents the lugs 66 from entering the next slot 72 in the grapple housing, i.e., it is the stopping of the lugs 77 that prevents the central mandrel 21 from unlocking from the grapple housing 24, that is until the central mandrel's rotation is reversed (right-hand rotation) to again align the lugs 66 with a slot 72 and thereby free the lugs 66 from the groove 68.

FIG. 7A shows a central mandrel 100 like the central mandrel 21 which is particularly suited for an embodiment of the present invention in which a marine swivel is used as described herein. In such an application a system according to the present invention may be like the systems of FIGS. 1 and 2, but without any mud motor or safety clamps. In such a system, a marine swivel is disposed on top of the bonnet 23 and the marine swivel, preferably, has a lower beveled edge that corresponds to a top beveled edge of the bonnet. The system is interconnected with a drill string that passes through the marine swivel and the drill string rotates the system From above.

FIG. 6 shows the drain sub 44 with a flow bore 121 here through from top to bottom and an exhaust port 122 (any desired and appropriate number of exhaust ports may be used). It is within the scope of this invention to relieve fluid pressure below a mud motor with any apparatus which allows a part of the total fluid flow to bypass the casing cutter, including but not limited to any known dump sub or sub with orifices or ports originally blocked by ruptureable discs or shear members. An orifice 123 is held in place in the exhaust port 122 by a snap ring 124. Use of such an orifice, or one of a series of orifices with different inner diameters, permits precise control of the fluid flowing from the drain sub. In one particular embodiment the total flow to the lower mud motor is about 875 gallons per minute, the flow out the exhaust port 122 is about 475 gallons per minute, and the flow to the casing cutter is about 400 gallons per minute. In this aspect the flow bore 121 has a diameter of about 0.689 inches and the exhaust port 122 has a diameter of about 0.75 inches. A dump sub can be positioned anywhere below the lower mud motor part and above the casing cutter.

FIG. 8A shows a central mandrel 150 for use in a system (as shown in FIGS. 1 and 2 with a mud motor. Appropriate subs (not shown) are connected above and below the central mandrel 150 so the resulting combination looks like the mandrel of FIG. 7A, but the inner diameter of the mandrel 150 is sized to accommodate the power shaft of the mud motor. The lugs 166 correspond to the lugs 66 of the mandrel of FIG. 3A. A grove 181 in the grapple housing 24 accommodates a seal (not shown) and/or one or more removable shims of different dimensions so that the grapple housing can fit over a variety of wellheads and can accommodate each of them In conclusion, therefore, it is seen that certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A system for cutting wellbore casing, the system comprising engaging apparatus for releasably holding a wellbore device, casing cutting apparatus interconnected with and below the engaging apparatus for cutting casing in a wellbore, the wellbore device connected to the casing, locking apparatus for selectively and releasably locking the engaging apparatus holding the wellbore device, a fluid relief device positioned above the casing cutting apparatus in a string including the casing cutting apparatus, the engaging apparatus, and the fluid relief device, the fluid relief device having at least one exhaust port therethrough, and a portion of fluid pumped from pumping apparatus at an earth surface into a wellbore in which the system is disposed flowable through the fluid relief device to the casing cutter for operation thereof and an exhaust portion of the fluid exhausting through the at least one exhaust port so that the exhaust portion does not flow through the casing cutter.

2. The system of claim 1 wherein the exhaust portion is of sufficient size that circulation of cuttings and debris resulting from cutting of the casing is inhibited.

3. The system of claim 2 wherein the exhaust portion is of sufficient size that the circulation of cuttings and debris is substantially eliminated.

4. A system for cutting wellbore casing, the system comprising a drill string extendable into a wellbore in which the wellbore casing is disposed, engaging apparatus for releasably holding a wellbore device connected to the casing, the engaging apparatus connected to the drill string so that raising of the drill string retrieves the wellbore device and casing above a location of cutting of the casing, casing cutting apparatus interconnected with and below the engaging apparatus for cutting casing in a wellbore, the wellbore device connected to the casing, locking apparatus for selectively and releasably locking the engaging apparatus holding the wellbore device, a plurality of latching arms movably mounted on the engaging apparatus, said arms selectively movable to engage the wellbore device, each arm having a top surface, each arm mounted below a top bonnet of the engaging apparatus, and a series of holes through the top bonnet, at least one hole having a lower opening above each of the arms, a fluid relief device positioned above the casing cutting apparatus in a string including the casing cutting apparatus, the engaging apparatus, and the fluid relief device, the fluid relief device having at least one exhaust port therethrough, and a portion of fluid pumped from pumping apparatus at the earth surface into a wellbore in which the system is disposed flowable through the fluid relief device to the casing cutter for operation thereof and an exhaust portion of the fluid exhausting through the at least one exhaust port so that the exhaust portion does not flow through the casing cutter.

5. The system of claim 1 wherein the wellbore device is connected to the casing and the engaging apparatus is connected to a drill string whose raising retrieves the wellbore device and casing above the location of the cutting.

6. The system of claim 1 further comprising a plurality of latching arms movably mounted on the engaging apparatus, said arms selectively movable to engage the wellbore device, each arm having a top surface, each arm mounted below a top bonnet of the engaging apparatus, and a series of holes through the top bonnet, at least one hole having a lower opening above each of the arms.

7. The system of claim 1 further comprising a plurality of latching arms movably mounted on the engaging apparatus, said arms selectively movable to engage the wellbore device, each arm having a top surface, each arm having at least one notch in the top surface thereof.

8. The system of claim 1 further comprising a mud motor interconnected with the casing cutting apparatus for rotating the casing cutting apparatus to cut casing.

9. The system of claim 8 further comprising the mud motor having an upper part above the engaging apparatus and a lower part between the engaging apparatus and the casing cutting apparatus, and clamp apparatus clamped to the upper part of the mud motor for abutment against the engaging apparatus to limit downward movement thereof and thereby limiting downward movement of the casing cutter and the extent of cutting of the casing.

10. A method for cutting casing from a wellbore extending down into the earth, the wellbore having a wellhead at an earth surface, the method comprising engaging the wellhead with engaging apparatus of a casing cutting system, the system comprising the engaging apparatus for releasably holding a wellbore device, casing cutting apparatus interconnected with and below the engaging apparatus for cutting casing in a wellbore, connected to the casing, and locking apparatus for selectively and releasably locking the engaging apparatus holding the wellbore device, selectively and releasably locking the engaging apparatus on the wellhead, and cutting the casing below the wellhead with the casing cutting apparatus, wherein the system further comprises a fluid relief device positioned above the casing cutting apparatus in a string including the casing cutting apparatus, the engaging apparatus, and the fluid relief device, the fluid relief device having at least one exhaust port therethrough, a portion of fluid pumped from pumping apparatus at the earth surface into a wellbore in which the system is disposed flowable through the fluid relief device to the casing cutter for operation thereof and an exhaust portion of the fluid exhausting through the at least one exhaust port so that the exhaust portion does not flow through the casing cutter, the method further comprising relieving fluid flow to the casing cutting apparatus by flowing the exhaust portion out through the at least one exhaust port.

11. The method of claim 10 wherein the wellbore device is connected to the casing and the engaging apparatus is connected to a drill string whose raising retrieves the wellbore device and casing above a location of the cutting, the method further comprising retrieving the wellhead and casing above the location of the cutting by raising the drill string.

12. The method of claim 10 wherein the exhaust portion is of sufficient size that circulation of cuttings and debris away from a location of casing cutting is inhibited, the method further comprising inhibiting circulation of cuttings and debris away from the location of casing cutting.

13. The method of claim 10 wherein the system further comprises engaging apparatus for releasably holding the wellbore device, a plurality of latching arms movably mounted on the engaging apparatus, said arms selectively movable to engage the wellbore device, each arm having a top surface, each arm mounted below a top bonnet of the engaging apparatus, and a series of holes through the top bonnet, at least one hole having a lower opening above each of the arms, the method further comprising washing fluid over the latching arms, the fluid flowing through the series of holes.

14. The method of claim 10 wherein the method steps are carried out in a single trip into the wellbore.

15. The method of claim 11 wherein the method steps are carried out in a single trip into the wellbore.

16. An engaging device for releasably holding a wellbore wellhead, the apparatus comprising engaging apparatus for releasably holding the wellbore wellhead, a plurality of latching arms movably mounted on the engaging apparatus, said arms selectively movable to engage the wellbore wellhead, each arm having a top surface, each arm having at least one fluid flow hole therethrough to facilitate debris removal from the arm.

17. An engaging device for releasably holding a wellbore wellhead, the apparatus comprising engaging apparatus for releasably holding the wellbore wellhead, a plurality of latching arms movably mounted on the engaging apparatus, said arms selectively movable to engage the wellbore wellhead, each arm having a top surface, each arm mounted below a top bonnet of the engaging apparatus, and a series of fluid flow holes through the top bonnet, at least one hole having a lower opening above each of the arms for facilitating debris removal from the arms.

18. A system for cutting wellbore casing, the system comprising engaging apparatus for releasably holding the wellbore device, casing cutting apparatus interconnected with and below the engaging apparatus for cutting casing in a wellbore, the wellbore device connected to the casing, and locking apparatus for selectively and releasably locking the engaging apparatus holding the wellbore device, said locking apparatus including a central mandrel movable up and down within the system for holding the engaging apparatus in an engaging position about the wellbore device and the locking apparatus for releasably preventing both upward and downward movement of the central mandrel while the engaging apparatus is engaging the wellbore device.

19. The system of claim 18 further comprising a mud motor interconnected with the casing cutting apparatus for rotating the casing cutting apparatus to cut casing.

20. The system of claim 18 wherein the engaging apparatus includes a grapple housing with a plurality of spaced-apart arms pivotably mounted thereto, the arms for releasably engaging the wellbore device, the grapple housing having a series of spaced apart first slots and a series of grooves each groove associated with each slot of the series of first slots, the central mandrel having a series of lugs projecting therefrom, each lug of the series of lugs movable within a first slot to a level corresponding to each groove of the series of grooves, each lug movable from a first slot into a groove by raising and then rotating the central mandrel, the central mandrel prohibited from upward and downward movement when the lugs are in the grooves.

21. A method for cutting casing from a wellbore extending down into the earth, the wellbore having a wellhead at the earth surface, the method comprising engaging the wellhead with engaging apparatus of a casing cutting system, the system comprising the engaging apparatus for releasably holding the wellbore device, casing cutting apparatus interconnected with and below the engaging apparatus for cutting casing in a wellbore, connected to the casing, and locking apparatus for selectively and releasably locking the engaging apparatus holding the wellbore device, said locking apparatus including a central mandrel movable up and down within the system for holding the engaging apparatus in an engaging position about the wellbore device and the locking apparatus for releasably preventing both upward and downward movement of the central mandrel while the engaging apparatus is engaging the wellbore device, selectively and releasably locking the engaging apparatus on the wellhead, and cutting the casing below the wellhead with the casing cutting apparatus.

22. The method of claim 21 wherein a wellbore device is connected to the casing and the engaging apparatus is connected to a drill string whose raising retrieves the wellbore device and casing above the location of the cutting, the method further comprising retrieving the wellhead and casing above the location of the cutting by raising the drill string.

* * * * *